US007841247B2

(12) United States Patent
Baumgardner

(10) Patent No.: US 7,841,247 B2
(45) Date of Patent: Nov. 30, 2010

(54) TEMPERATURE CONTROLLER FOR SMALL FLUID SAMPLES WITH DIFFERENT HEAT CAPACITIES

(75) Inventor: James E. Baumgardner, Folsom, PA (US)

(73) Assignee: Oscillogy LLC, Folsom, PA (US)

( * ) Notice: Subject to any disclaimer, the term of this patent is extended or adjusted under 35 U.S.C. 154(b) by 660 days.

(21) Appl. No.: 11/814,620

(22) PCT Filed: Jan. 20, 2006

(86) PCT No.: PCT/US2006/001967

§ 371 (c)(1),
(2), (4) Date: Jul. 24, 2007

(87) PCT Pub. No.: WO2006/081135

PCT Pub. Date: Aug. 3, 2006

(65) Prior Publication Data

US 2008/0006099 A1 Jan. 10, 2008

Related U.S. Application Data

(60) Provisional application No. 60/646,514, filed on Jan. 25, 2005.

(51) Int. Cl.
*G01N 1/22* (2006.01)

(52) U.S. Cl. ..... 73/863.11

(58) Field of Classification Search ..... None
See application file for complete search history.

(56) References Cited

U.S. PATENT DOCUMENTS 3,646,313 A 2/1972 Gorgone et al.
4,066,365 A 1/1978 Staunton
5,349,833 A * 9/1994 Pardee et al. ..... 62/55.5
5,456,104 A * 10/1995 Rosen ..... 73/29.02
5,498,392 A 3/1996 Wilding et al.
5,525,300 A 6/1996 Danssaert et al.

(Continued)

FOREIGN PATENT DOCUMENTS

EP 0 770 871 5/1997

(Continued)

OTHER PUBLICATIONS

International Search Report and Written Opinion of ISR, PCT/US2006/001967, dated Nov. 9, 2006.

(Continued)

*Primary Examiner*—Robert R Raevis
(74) *Attorney, Agent, or Firm*—Womble Carlyle

(57) ABSTRACT

A system for controlling the temperature of fluidic samples includes a device having a first outer surface and a second outer surface which are parallel to one another. The interior of the device contains two or more channels suitable for accommodating samples. The channels lay on a common plane that is also parallel to the first and second outer surfaces. A temperature sensor is positioned between the channels along the common plane. A heater is thermally coupled to one of the two outer surfaces while a heat sink is coupled to the other of the two outer surfaces, thereby establishing a temperature gradient between the first and second outer surfaces. A temperature controller receives sensed temperature input from the temperature sensor and adjusts the heater in response thereto.

31 Claims, 4 Drawing Sheets

U.S. PATENT DOCUMENTS

| | | | | |
|---|---|---|---|---|
| 5,593,838 | A | | 1/1997 | Zanzucchi et al. |
| 5,700,695 | A | * | 12/1997 | Yassinzadeh et al. ..... 436/180 |
| 5,736,106 | A | | 4/1998 | Ishiguro et al. |
| 5,863,502 | A | | 1/1999 | Southgate et al. |
| 6,225,047 | B1 | | 5/2001 | Hutchens et al. |
| 6,337,212 | B1 | | 1/2002 | Nagle et al. |
| 6,428,749 | B1 | | 8/2002 | Kajiyama et al. |
| 6,692,700 | B2 | | 2/2004 | Handique et al. |
| 2002/0143437 | A1 | | 10/2002 | Handique et al. |
| 2003/0180190 | A1 | | 9/2003 | Corcoran et al. |

FOREIGN PATENT DOCUMENTS

| | | |
|---|---|---|
| EP | 2004/108287 | 12/2004 |
| WO | 03/092893 | 11/2003 |

OTHER PUBLICATIONS

International Search Report in PCT/US2006/001967, dated Sep. 14, 2009.

Ivan Erill; Development of a CMOS-compatible PCR chip: comparison of design and system strategies; Journal of Micromechanics and Micorengineering; Aug. 9, 2004; pp. 1558-1568; Institute of Physics Publishing.

Dae Sung Yoon; Precise temperature control and rapid thermal cycling in a micormachined DNA polymerase chain reaction chip; Journal of Micromechanics and Microengineering; Oct. 3, 2002; pp. 813-823; Institute of Physics Publishing.

Office Action in counterpart Chinese Application No. 200680003015.7, mailed Jan. 8, 2010.

Extended European Search Report in counterpart EP Application No. 06718964.7, dated Aug. 4, 2009.

New European Search Report in counterpart EP Application No. 06718964.7, dated Sep. 14, 2009.

Paper filed in counterpart European Application No. 06718964.7, dated Nov. 24, 2009.

* cited by examiner

TEMPERATURE CONTROLLER FOR SMALL FLUID SAMPLES WITH DIFFERENT HEAT CAPACITIES

RELATED APPLICATIONS

The present application claims priority to U.S. Provisional Application No. 60/646,514, filed Jan. 25, 2005. The contents of the aforementioned provisional application are incorporated by reference in their entirety.

FIELD OF THE INVENTION

The present invention relates to temperature control devices used to maintain a temperature of fluidic samples. More particularly, it concerns such devices that are suitable for samples having different heat capacities.

BACKGROUND OF THE INVENTION

Certain kinds of analytic procedures require the analysis of multiple fluid samples, where the samples have markedly different thermal characteristics, for example different heat capacities. A specific example is the MIGET by MMIMS (Multiple Inert Gas Elimination Technique by Micropore Membrane Inlet Mass Spectrometry) analysis, in which inert gas partial pressures are measured in two blood samples and one gas sample (Baumgardner J E, Choi I-C, Vonk-Noordegraaf A, Frasch H F, Neufeld G R, Marshall B E. Sequential VA/Q distributions in the normal rabbit by micropore membrane inlet mass spectrometry. J Appl Physiol 2000; 89:1699-1708). At the beginning of analysis, the blood and gas samples are at room temperature (typically 22° C.) and the samples must be heated, and analyzed at body temperature (typically 37.0° C.). Yet these blood and gas samples have very different heat capacities. The fluid samples flow past their individual sensors for measurement of the inert gas partial pressures in the samples. In addition to the different heat capacities of the samples, the optimal flow rate of the gas and blood samples is different. Despite these two different thermal characteristics (heat capacity and sample flow rate), both samples must be analyzed at an identical, and precise, temperature.

Thermal characteristics that might vary between multiple fluid samples include heat capacity (as in MIGET by MMIMS), sample flow rate (as in MIGET by MMIMS), sample volumes (for example multiple arterial blood gas samples where each sample has a different volume), and initial sample temperature (for example samples from different sources that all need to be analyzed at the same temperature). Additionally, multiple sensors used to analyze samples may vary in their thermal characteristics, and yet in some instances it may be desired to perform the analyses with each sensor at the same temperature.

In addition to the need for temperature control of multiple samples in analytic applications, it is sometimes also desired to carry out two or more fluid phase chemical reactions and maintain these parallel reactions at the same temperature. Possible differences in thermal characteristics between reactions include different reactant feed temperatures; different reactant feed flows; different volumes of reactants; and different specific heats of reaction. Despite these differences in thermal requirements of the reactions, it may be desired to carry out the parallel reactions at precisely the same temperature.

When analyses of multiple fluid samples are to be carried out at the same temperature, it is often desired to precisely regulate that temperature during the entire time it takes to make the measurements. For example, in MIGET by MMIMS, analysis of the inert gas partial pressures takes several minutes, and precise control of the analysis temperature to within 0.1° C. during this time can increase the accuracy of the inert gas measurements. Similarly, in multiple parallel fluid phase reactions, it may be desirable to precisely control the reaction temperature during the entire course of the reaction. For example, in the polymerase chain reaction (PCR), precise control of reaction temperature at 72° C. for approximately 20 seconds during the extension reaction may increase the overall efficiency of DNA sample doubling (Chiou J, Matsudaira P, Sonin A, Ehrlich D. A closed-cycle capillary polymerase chain reaction machine. Analytical Chemistry 2001; 73:2018-2021).

In addition to the requirement to maintain multiple samples at the same constant temperature for a period of time, it is sometimes desirable also to change the analysis temperature rapidly between sets of samples. For example, in both MIGET by MMIMS and arterial blood gas (ABG) analyses, different samples are often drawn from patients or subjects at different body temperatures, and it is highly desirable to be able to change the controlled analyzer temperature from one body temperature to another as these sample sets are processed sequentially. Similarly, for the purposes of carrying out multiple parallel reactions, it is sometimes desirable to rapidly change the reaction temperature from one controlled temperature to another, for example the rapid changes in temperature desired between the denaturing, annealing, and extension reactions of PCR (Nagai H, Murakami Y, Yokoyama K, Tamiya E. High throughput PCR in silicon based microchamber array. Biosensors and Bioelectronics 2001; 16:1015-1019).

Thus, in both analytical applications and in fluid phase reactor applications, there are sometimes multiple requirements for the overall process of temperature control: (1) provide for the temperature regulation of multiple fluid samples, sensors, or fluid phase reactions when the individual samples, sensors, or reactions have widely differing thermal characteristics; (2) provide temperature regulation that is highly precise, and uniform over a specified period of time; (3) provide temperature regulation for all of the samples, sensors, or reactions, that is highly precise, and uniform amongst the multiple samples, sensors, or reactions; and (4) provide for rapid and predictable changes in the controlled temperature. In the design of temperature controllers, these competing requirements often conflict. In particular, controllers that are capable of precise and uniform temperature regulation over time and amongst samples are generally not also adept at rapid temperature changes. Conversely, temperature controllers that can provide rapid temperature changes are often not precise and uniform. Prior art has therefore approached these problems in different ways.

One approach has been to place the samples, sensors, or reactants in a block of material that is highly thermally conductive, for example an aluminum heater block. For example, Shoder et. al. reported on the performance of 6 commercially available thermal cyclers for PCR, all based on the conductive block design (Schoder D, Schmalwieser A, Schauberger G, Kuhn M, Hoorfar J, Wagner M. Physical Characteristics of Six New Thermocyclers. Clinical Chemistry 2003; 49:960-963). Because of the high thermal conductivity, the block tends to be isothermal. Controlling the temperature of the samples within the block is then a relatively simple matter of controlling the block temperature. Because there are few restrictions on the size of the device used to measure block temperature, the block temperature can be measured with a highly accurate sensor such as a thermistor, or an integrated circuit type of sensor. Feedback control of block temperature requires only one control loop regulating the output of a block heater. In the conductive heater block approach, accuracy of temperature control is usually very good; also, samples that are uniform in their thermal characteristics will be uniformly controlled to the same temperature. This approach, however, has several disadvantages. First, if the samples have widely varying thermal characteristics, their temperatures will not always be uniform, because local variations within the block are not monitored or independently regulated. Second, the thermal mass of the block is usually substantially larger than the thermal mass of small liquid samples. The large thermal mass of the block makes it difficult to change sample temperature rapidly. When a rapid change in temperature is desired, such as step change to a new temperature, control algorithms such as PID (proportional-integral-derivative), which are well-known to those skilled in art, typically make a tradeoff between rapid changes versus overshoot of the target temperature. (Schoder D, Schmalwieser A, Schauberger G, Kuhn M, Hoorfar J, Wagner M. Physical Characteristics of Six New Thermocyclers. Clinical Chemistry 2003; 49:960-963).

A second approach to controlling the temperature of multiple samples, sensors, or reactions has been individual and independent heating of each sample. For example, Friedman and Meldrum reported a novel film resistor approach for thermal control of individual capillaries for PCR (Friedman N A, Meldrum D R. Capillary tube resistive thermal cycling. Analytical Chemistry 1998; 79:2997-3002). In this approach, the temperature of each sample, sensor, or reaction is independently measured, and used to control the output of an individually regulated heater. This approach easily accommodates multiple samples with widely varying thermal characteristics, because each sample is independently regulated. Also, the thermal mass of the individually heated parts is typically small, making it possible to change temperatures rapidly. This approach, however, has some disadvantages. For very small fluid samples, it introduces the complexity of measuring temperature in a very small sample. Temperature sensors amenable to miniaturization, such as thermocouples, do not provide accuracy comparable to larger sensors, such as thermistors. Also, it is often impractical to measure the fluid sample temperature directly, and a surrogate temperature (for example temperature on the surface of a capillary where the capillary contains the sample) is measured instead (Friedman N A, Meldrum D R. Capillary tube resistive thermal cycling. Analytical Chemistry 1998; 79:2997-3002). However, without the essentially isothermal temperature field provided by a conductive block, this can lead to errors in sample temperature measurement. As a result, individually controlling the temperatures of small fluid samples allows rapid changes in temperature, but does not usually result in the precision or uniformity (over time and between samples) of temperature control that is provided by a conductive block.

Certain kinds of applications, in particular the MIGET by MMIMS analysis, therefore present multiple performance requirements that are not completely satisfied by prior art. While prior art presents designs that meet these performance requirements individually, there is no prior art approach that meets all of these performance requirements.

A number of U.S. patents are directed to the general field of controlling the temperature of samples.

U.S. Pat. No. 6,730,883 teaches that earlier heater assemblies for carrying out PCR in discrete (i.e. non-flowing) samples in sample tubes did not provide uniform thermal contact with each sample tube cap, resulting in non-uniformity of temperature control between the samples, resulting in less efficiency of the PCR reactions. This patent teaches the use of a flexible heating cover assembly that provides uniform thermal contact to each sample tube cap. The device is preferably used in conjunction with a thermal heating block that holds the sample tubes. The thermal heating block teaches the use of various heater elements such as thermoelectric and resistive, and heat sinks such as forced convection and thermoelectric, but does not teach limitation of the samples to essentially a single plane positioned between a heat source and heat sink. The device also does not discuss the use of channels for flowing samples through the heater block.

U.S. Pat. No. 6,703,236 also teaches that in earlier thermal conductive blocks for discrete samples for the PCR reaction, non-uniformity of temperatures between samples was a problem that led to less efficiency. This patent teaches the use of a thermal block with heating provided by a resistive heater and cooling provided by flowing a liquid coolant through flow channels machined in the block. The cooling channels are interposed between the heater elements and the samples.

U.S. Pat. No. 6,692,700 teaches the use of large diameter leads to resistive heaters in microfluidic devices, to reduce unwanted heating of the leads as they pass through the device. This patent also teaches the use of thermoelectric chips to cool microfluidic devices.

U.S. Pat. No. 6,673,593 teaches the use of an integral semiconductor heater for applying heat in microfluidic devices.

U.S. Pat. No. 6,666,907 teaches the use of a thin film resistor in contact with a gas chromatography column where the resistor is used to directly heat the column, and the resistance is monitored to provide integral temperature sensing. The device provides a microfluidic approach to temperature programming for GC analysis.

U.S. Pat. No. 6,657,169 teaches that uniform temperature regulation of all samples of PCR is highly desirable, and teaches a conductive block for uniform heating of liquid samples. The patent teaches a thermal conductive block for heating PCR samples tubes, with resistive and thermoelectric heating elements and a natural convection heat sink, with the heaters positioned between the samples and the heat sink.

U.S. Pat. No. 6,579,345 teaches the direct heating of a capillary column for temperature programming, for gas chromatography. This patent teaches that requirements for rapid temperature changes conflict with requirements for precise temperature regulation, and teaches the use of a predictive, feed-forward control algorithm for use in conjunction with more traditional feedback control algorithms.

U.S. Pat. No. 6,558,947 teaches the use of special sleeves for holding PCR sample tubes, where each sleeve is individually heated, and each sleeve conducts heat to a heat sink. Each sample well is equipped with a temperature monitor, and the temperature of each sample tube is independently regulated.

U.S. Pat. No. 6,541,274 teaches the use of heat exchangers inserted into microfluidic fluid receptacles for controlling reaction temperatures.

U.S. Pat. No. 6,533,255 teaches the use of liquid metal for uniform temperature regulation of multiple samples, preferably used for PCR reactions.

U.S. Pat. No. 4,443,407 teaches a device for analyzing small blood samples at a fixed and controlled temperature of 37.0° C. The samples flow through a sample cell that is in thermal contact on both sides with conductive heater blocks, each maintained at 37.0° C. The heater blocks are heated with resistive heaters, and the blocks have several exposed surfaces that lose heat to the environment by natural convection.

U.S. Pat. No. 4,415,534 teaches a device for analyzing small blood samples at a fixed and controlled temperature of 37.0° C. The blood samples flow through a conductive measuring block, which contains the electrode sensors for various analyses. The conductive measuring block is surrounded by a conductive heat shield, with good thermal contact between the measuring block and heat shield at a conductive base member. Both the measuring block and the heat shield are maintained at 37.0° C. with heat supplied by a power transistor.

SUMMARY OF THE INVENTION

In accordance with the present invention there is preferably provided a temperature controlled fluidic sample system. The system includes a fluidic sample device comprising a first substrate block having a first inner surface and a first outer surface, a second substrate block having a second inner surface and a second outer surface, a first groove formed in the first inner surface, the first groove having first and second ends opening to a peripheral edge of the first substrate block, the first and second inner surfaces of the first and second substrate blocks facing each other so as to form a first through channel between the first and second substrate, wherein the first through channel has first and second ends opening to a peripheral edge of the fluidic sample device, the first through channel incorporates said first groove, the first through channel is located between two imaginary planes that are spaced apart by a height (h) of the first through channel, the two imaginary planes being parallel to one another and defining between them a first volume in which the first through channel resides; and at least one temperature sensor configured to measure a temperature within the first volume. The system also includes a heater thermally coupled to one of said first and second outer surfaces, a heat sink thermally coupled to the other of said first and second outer surfaces; and a temperature controller configured to receive temperature information from said temperature sensor and output a signal to control at least one of the heater and the heat sink in response thereto such that a temperature gradient is formed between said one of said first and second outer surfaces and said other of said first and second outer surfaces, and a desired temperature is maintained within said first volume.

In another aspect, the present invention is directed to a temperature controlled fluidic sample system comprising a fluidic sample device having first and second outer surfaces and at least one internal compartment configured to hold a fluid sample, said compartment being located between two imaginary planes that are spaced apart by a height (h) of said compartment, the two imaginary planes being parallel to one another and also parallel to the first and second outer surfaces, the two imaginary planes defining between them a first volume in which the compartment resides; at least one temperature sensor configured to measure a temperature within the first volume; a heater thermally coupled to one of said first and second outer surfaces; a heat sink thermally coupled to the other of said first and second outer surfaces; and a temperature controller configured to receive temperature information from said temperature sensor and output a signal to control the heater in response thereto such that a temperature gradient is formed between said one of said first and second outer surfaces and said other of said first and second outer surfaces; and a desired temperature is maintained within said first volume.

In yet another aspect, the invention is directed to a method of controlling temperature of at least two fluidic samples having different heat capacities. The inventive method comprises: passing first and second fluidic samples along first and second paths formed in a common device, the first fluidic sample having a first heat capacity and the second fluidic sample having a second heat capacity, said first and second paths being substantially along a common plane within said device; applying a heat gradient in a direction orthogonal to said plane such that a uniform heat flux passes through said plane; measuring a temperature of the device at a point in said plane, said point being between the first and second paths; and adjusting a heater thermally coupled to said device, based on the measured temperature of the device.

PID control may be used to control the temperature in any of the foregoing.

BRIEF DESCRIPTION OF THE DRAWINGS

For a better understanding of the present invention and to show how the same may be carried out in practice, reference will now be made to the accompanying drawings, in which.

DETAILED DESCRIPTION OF A PREFERRED EMBODIMENT

Figure 1:
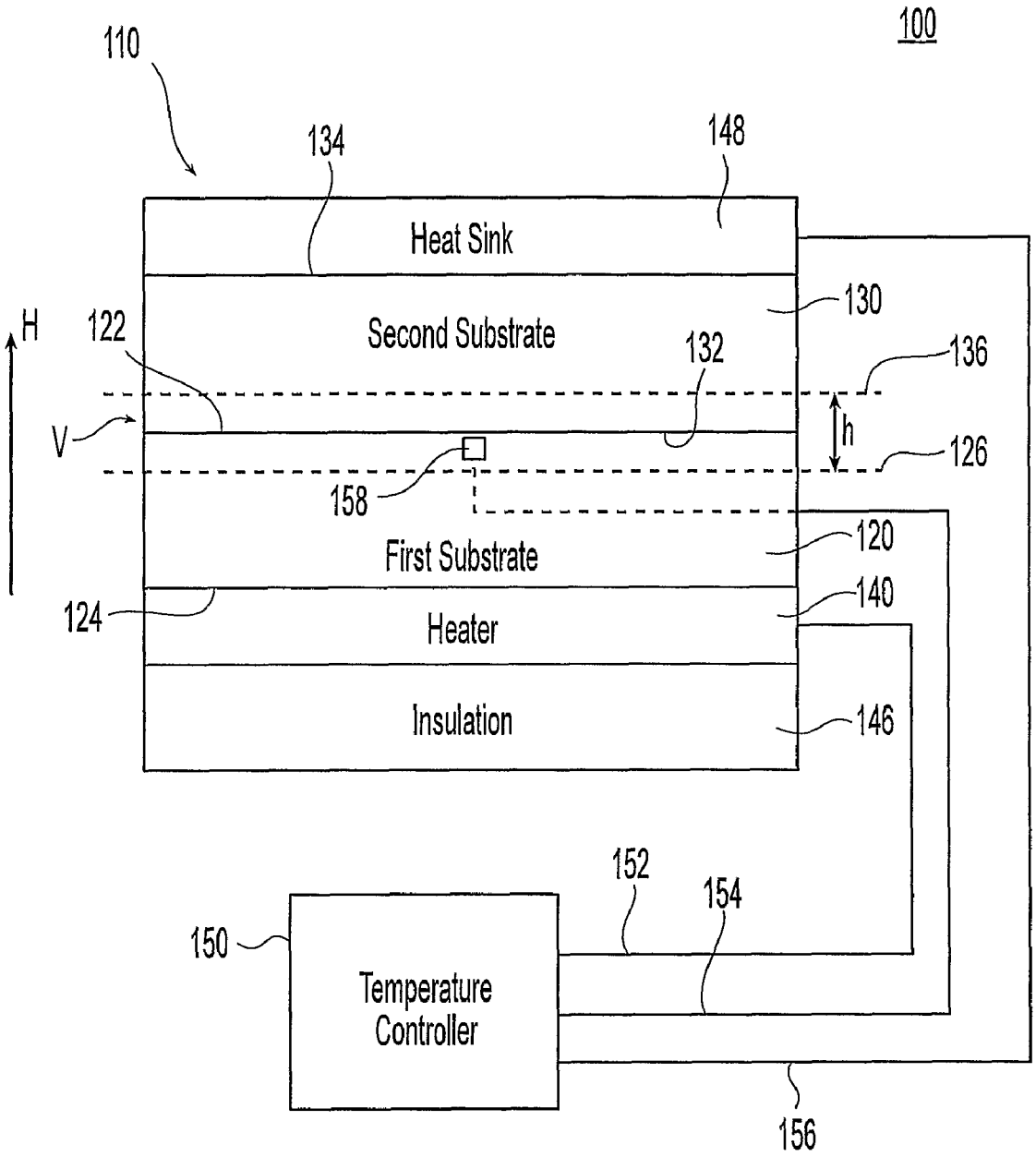
FIG. 1 shows a system in accordance with the present invention with fluidic chip assembly shown in a side view.

FIG. 1 shows an embodiment of a system 100 in accordance with the present invention. The system includes a fluidic chip assembly 110 and a temperature controller 150. The fluidic chip assembly 110 includes a first substrate block 120 and a second substrate block 130. The first substrate block 120 has a first inner surface 122 and first outer surface 124, while the second substrate block 130 has a second inner surface 132 and second outer surface 134. The first and second substrate blocks 120, 130 are such that, in the assembled state and during use, the first inner surfaces 122, 132 oppose, or face, each other and, more preferably, abut one another. Also, the first and second substrate blocks 120, 130 are such that, in the assembled state and during use, the first and second outer surfaces 124, 134, preferably are planar and parallel to one another.

As is known to those skilled in the art, the first and second substrate blocks typically are separately formed, one or both being provided with wells, grooves, compartments, receptacles, through passages, and other formations, often formed by etching or drilling. In addition, one substrate block may be the mirror image of the other. Alternatively, one substrate block may have some formations that are complementary and other formations that are identical to those on the other substrate block, and still other variations are also possible. Generally, the two substrate blocks are brought together and secured to one another to form an assembled fluidic chip. A pair of grooves, one formed on each substrate block, may then form a channel in the assembled fluidic chip, and fluids may be introduced into such a channel, all as known to those skilled in the art.

First and second substrate blocks 120, 130 are formed of a thermally conductive material. Thus, they may comprise such materials as aluminum, copper, silicon, or glass, among others. The first outer surface 124 of the first substrate block 120 is thermally coupled to a heater 140 at a first temperature. Preferably, the entire effective area of the first outer surface 124 is covered by the heater 140. Thus, the heater 140 is configured so as to provide a uniform amount of heat per unit area to the first outer surface 124. The other side of the heater 140 is covered by a layer of insulation 146 that assures that heat lost to the surroundings is negligible. The heater 140 itself may be implemented by resistive heating, by a thermoelectric chip, by a flowing heated fluid, or by other such means known to those skilled in the art.

The second outer surface 134 of the second substrate block 130 is thermally coupled to a heat sink 148 at a second temperature lower than the first temperature. Preferably, the entire effective area of the second outer surface 134 is covered by the heat sink and so heat may be dissipated uniformly across the second outer surface 134. In one embodiment, the heat sink 148 is a thermoelectric chip. In another embodiment, the heat sink 148 comprises flowing fluid at a temperature lower than that of the heater 140. In yet another embodiment, the heat sink 148 is simply room temperature, perhaps with a fan blowing to circulate air at the second outer surface 134 of the second substrate block. A layer of protective material, such as insulation (not shown) may be used to cover the heat sink 148 in some embodiments. As seen in FIG. 1, the first outer surface 124 and the second outer surface 134 overlap one another in a direction between the heater and the heat sink, which direction is perpendicular to at least one of the outer surfaces 124, 134.

First and second imaginary planes 126, 136, respectively, are defined within the chip assembly 110. As seen in the embodiment of FIG. 1, first imaginary plane cuts through the first substrate block 120 and second imaginary plane 136 cuts through the second substrate block 130. The imaginary planes 126, 136 are parallel to one another. Preferably, the imaginary planes 126, 136 are also parallel to both the first and second inner surfaces 122, 132 of first and second substrate blocks 120, 130, respectively, in the assembled state.

The imaginary planes 126, 136 are spaced apart by a distance h and define therebetween a first volumetric slice V within the assembled chip. It is understood that this first volumetric slice is defined by those portions of the two substrate blocks 120, 130 that are between the first and second imaginary planes 126, 136. It is further understood that FIG. 1 is not a proportional drawing and that the distance h is usually very small, on the order of a channel diameter, which may be on the order of 10-50 microns or so. Thus, the spacing h between the two imaginary planes is so small that the first volumetric slice may, for thermal purposes, effectively be considered a single planar region. In the present invention, wells, channels and other compartments for accommodating fluid samples within the device 110 preferably are found only within the volumetric slice V.

By virtue of a heat source 140 and a heat sink 148, it is understood that a temperature gradient, indicated by the arrow H, is created between the first outer surface 124 and the second outer surface 134. Given parallel first and second outer surfaces 124, 134, uniform heat transfer between the heater 140 and the first outer surface 124, and uniform heat transfer between the second outer surface 134 and the heat sink, the heat flux is orthogonal to the two imaginary planes 126, 136.

A temperature sensor 158 is provided within the first volume V. Thus, in an assembled fluidic chip having wells, channels or other voids within that first volume, the temperature sensor 158 is in a suitable position for ascertaining temperatures of fluids present in such compartments. Furthermore, in one embodiment, the temperature sensor preferably is positioned between two or more such compartments so as to output a single temperature corresponding to a spatial position that is more or less equidistant from both compartments. It is understood that in other embodiments, more than one such temperature sensor may be provided.

As seen in FIG. 1, a temperature sensor lead 154 connects the temperature sensor 158 to a temperature controller 150. It is understood that the temperature controller 150 may comprise a user interface, processor, temperature control algorithms, and the like. The temperature controller 150 receives temperature readings from temperature sensor 158, and outputs a first temperature control signal 152 to the heater 140. The first temperature control signal 152 preferably adjusts the temperature of the heater 140. In some embodiments, the temperature controller 150 may output a second temperature control signal 156 to the heat sink 148. The second temperature control signal 156 may adjust the temperature of a thermoelectric device, a flow rate of a fluid, the speed of a fan, or the like, depending on the nature of the heat sink provided.

Figure 2A:
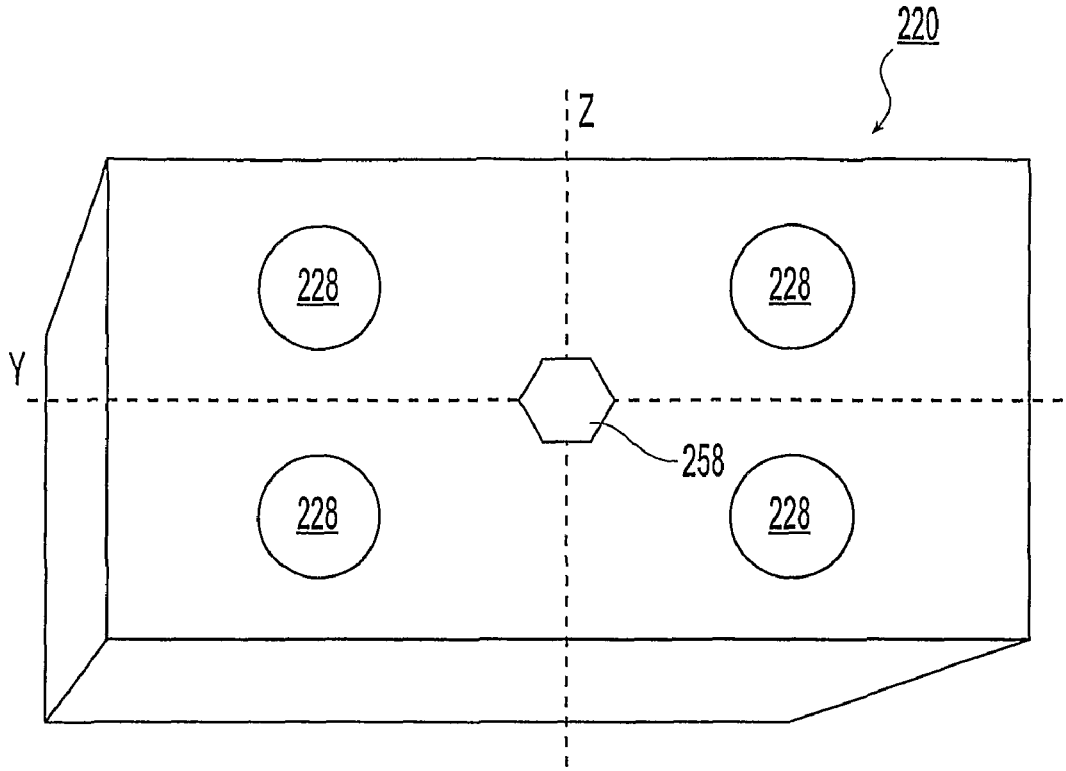
FIG. 2A shows a perspective view of a first embodiment of a substrate in accordance with the present invention.

FIG. 2A shows a first substrate block 220 whose first inner surface 222 lays in the y-z plane, as shown. The inner surface 222 is provided with a plurality of wells 228 suitable for accommodating a liquid. The inner surface is also provided with a temperature sensor 258. While the temperature sensor 258 is shown to be in the middle of the first inner surface, this is not a requirement. Preferably, though, the temperature sensor 258 is positioned between the wells in both the y-direction and the z-direction. Furthermore, while an array of only four wells is shown in this embodiment, it is understood that larger numbers of wells, such as an array of 4×8, 8×12, or even more, may be provided.

Figure 2B:
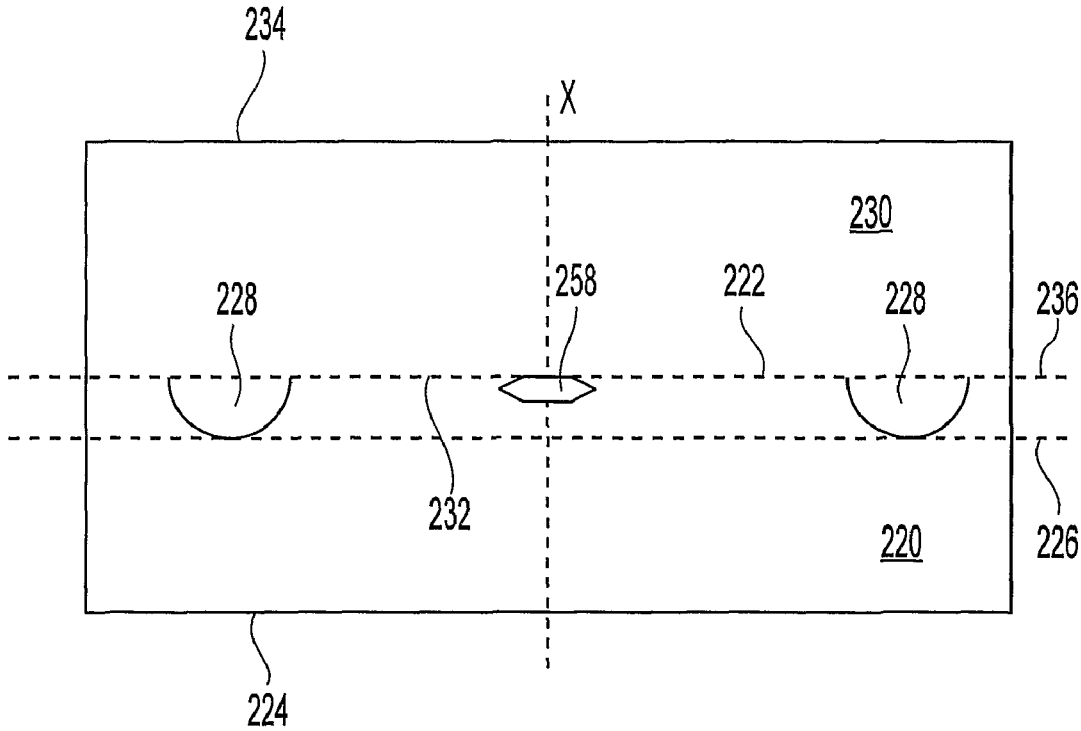
FIG. 2B shows a side view of a fluidic chip using the substrate of FIG. 2A.

FIG. 2B shows the second substrate block 230 atop the first substrate block 220. In this embodiment, the wells 228 are present in the lower, first substrate block 220. A first imaginary plane 226 is formed in the first substrate block 220 while the second imaginary plane 236 is coincident with the abutting first and second inner faces 222, 232, respectively, which is also coincident with the y-z plane of FIG. 2A. As seen in FIG. 2*b*, the spacing between the two imaginary planes 226, 236 is approximately the same as the depth of the wells 228. The temperature sensor 258 is therefore within the volume defined between these two imaginary planes, and so is positioned to gauge the temperature at a point in the x-direction that more or less corresponds to the position of the wells in the x-direction. The wells 228, and thus the samples in them, are configured such their dimensions in the x direction are small compared to the distance between the heat source and heat sink.

The heater, insulation, temperature controller, heat sink, and other items seen in FIG. 1 have been omitted for simplicity in FIG. 2B, but are present. In the embodiment of FIG. 2B, the heater preferably is placed below the first substrate block 220 and is composed in a fashion to provide a uniform amount of heat per unit area over the entire first outer surface 224. Thus, the heat gradient is upward on the page along the x-axis, and the heat flux is conducted through the device in a direction that is orthogonal to the first and second outer surfaces 224, 234, the imaginary planes 226, 236, and the y-z plane.

The heat sink is composed in a fashion to provide a uniform amount of heat absorption per unit area over the second outer surface 234. The heat sink can be provided by forced convection of air to transfer heat to the environment, by a thermoelectric chip, by a flowing cooled fluid, or a combination of these such as forced air convective transfer to a regulated, cooled thermoelectric chip. One element of the design is selection of the optimal heat flux from heat source to heat sink. The heat flux from heat source to heat sink should be large enough that the heat flux per unit area, times the average area of a sample in the wells 228, is large compared to the heat required to raise each sample to the analysis temperature. On the other hand, the heat flux should be small enough that the temperature gradient in the x direction is small. Preferably the temperature gradient in the x direction should be small enough that the temperature change over the thickness of the samples in the x direction is within acceptable limits.

The temperature sensor 258 is placed between the two imaginary planes 226, 236 for feedback control of the samples' temperature. The temperature sensor is preferably a device that maintains high accuracy over time with minimal calibration, such as a thermistor. The device can be operated in either of two control modes, or a combination of the two control modes. For control of the y-z plane at a steady temperature over time, control can be conventional PID control of the heater output, the heat transfer to the heat sink, or some combination of these. For control of the y-z temperature during rapid programmed temperature changes, such as a step increase or decrease, control is preferably carried out by smart control algorithms that adjust the time profiles of heat input and heat output to manipulate the y-z temperature in a predictive fashion.

Figure 3A:
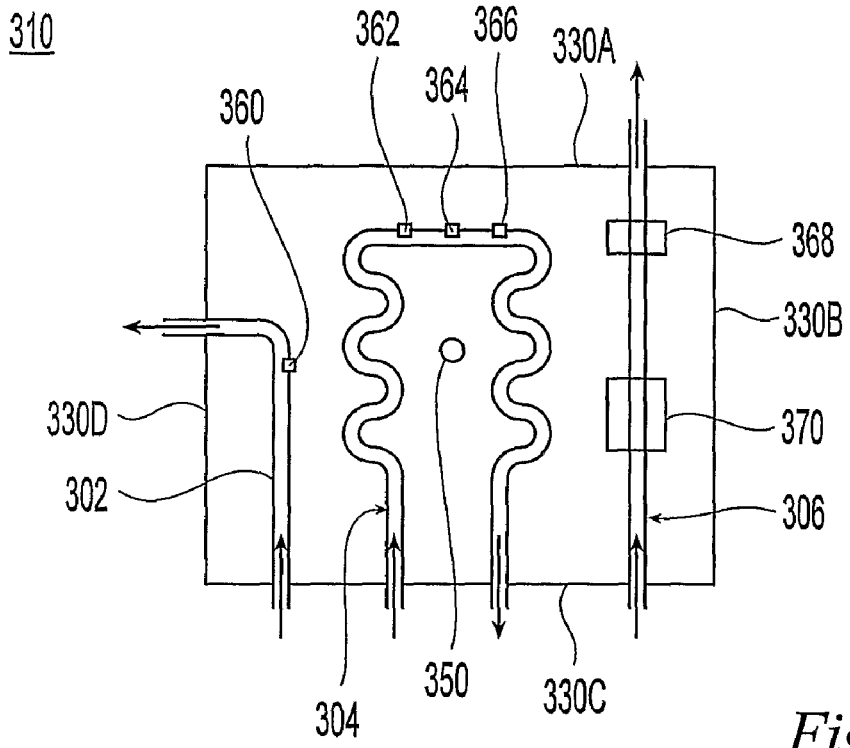
FIGS. 3A and 3B show a second embodiment of a substrate and a side view of a fluidic chip assembly formed with the substrate.
Figure 3B:
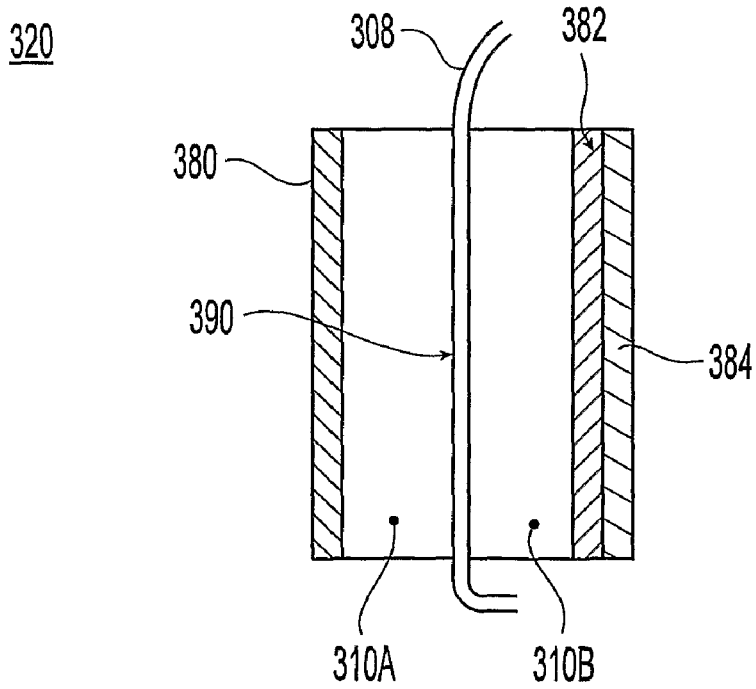

FIGS. 3A & 3B show another embodiment of a substrate block 310 and device 320 in accordance with the present invention. In this embodiment, rather than occupying wells, the fluid samples flow through one or more through channels formed in the fluidic chip. Identical grooves 302, 304, 306 are machined or etched in each of a pair of substrate blocks, each end of each groove communicating with a peripheral edge 330A, 330B, 330C, 330D of the substrate block 310, and the arrows in FIG. 3A showing the direction of fluid flow. Each channel is then created from two identical grooves when the substrate blocks are brought together with the grooves opposing each other, each channel communicating with a peripheral edge of the fluidic chip and thereby defining a path through which fluids may flow.

The thickness of each channel in the x-direction is thus twice the depth of each groove. Thus, each channel is bounded by two imaginary planes, each plane cutting through one substrate block and being parallel to a corresponding inner surface (i.e. the y-z plane). The spacing between the imaginary planes corresponds to the thickness of the channels in the x-direction.

The fluid samples may flow in the channels 390 or, alternatively, may flow through tubing 308 that is accommodated in the channels and is in good thermal contact with the substrate blocks 310A, 310B. One substrate block 310A may be abutted by a heat sink 380 of the sort discussed above with respect to FIG. 1, while the other substrate block 310B may be abutted by a heater 382 of the sort discussed above. Insulation material 384 may abut the other side of the heater 382. It is understood that in FIGS. 3A and 3B, the temperature controller and sensor leads have been omitted for simplicity.

There can be a plurality of fluid channels and temperature sensors, all arranged in the same narrow volumetric slice between the two imaginary planes. In one embodiment, a plurality of parallel pairs of fluid through channels are provided, each pair having its own temperature sensor. In another embodiment, a single temperature sensor is used in conjunction with 4 or more such channels. In still other embodiments, 8, 16, 32, 64, 96 or even 128 microchannels are formed in a fluidic chip and a single temperature sensor 350, co-planar with all the microchannels, is employed.

The grooves, and thus the resulting channels, may be formed to have any complex or serpentine pattern so long as the channels are confined to a single plane (or, more exactly, to the narrow volumetric slice between the two imaginary planes). It is understood in comparing FIGS. 3A and 3B, that FIG. 3A simply shows some of the groove types (right-angled 302, serpentine 304 & straight 306) that may be formed, while FIG. 3B simply shows that the resulting channels, generally shown as 390, extend along the interface between the two substrates.

A device 320 may have non-temperature sensors in addition to temperature sensors. Analytic sensors 360, 362, 364, 366 for measuring fluid properties can be in direct contact with the samples. Alternatively, they can be based on non-contact measurements such as an optical sensor 368 for optical measurement of fluorescence. Preferably, the analytic probes are small enough that their thickness in the x direction is small compared to the thickness of the substrate blocks. Such probes may have different thermal characteristics. Sensors particularly suited for this purpose include needle shaped electrodes such as $PO_2$ and pH electrodes, and needle-shaped sensors for MMIMS. The design is also well suited to sensors with a planar geometry such as chip-based sensors 370.

Figure 4A:
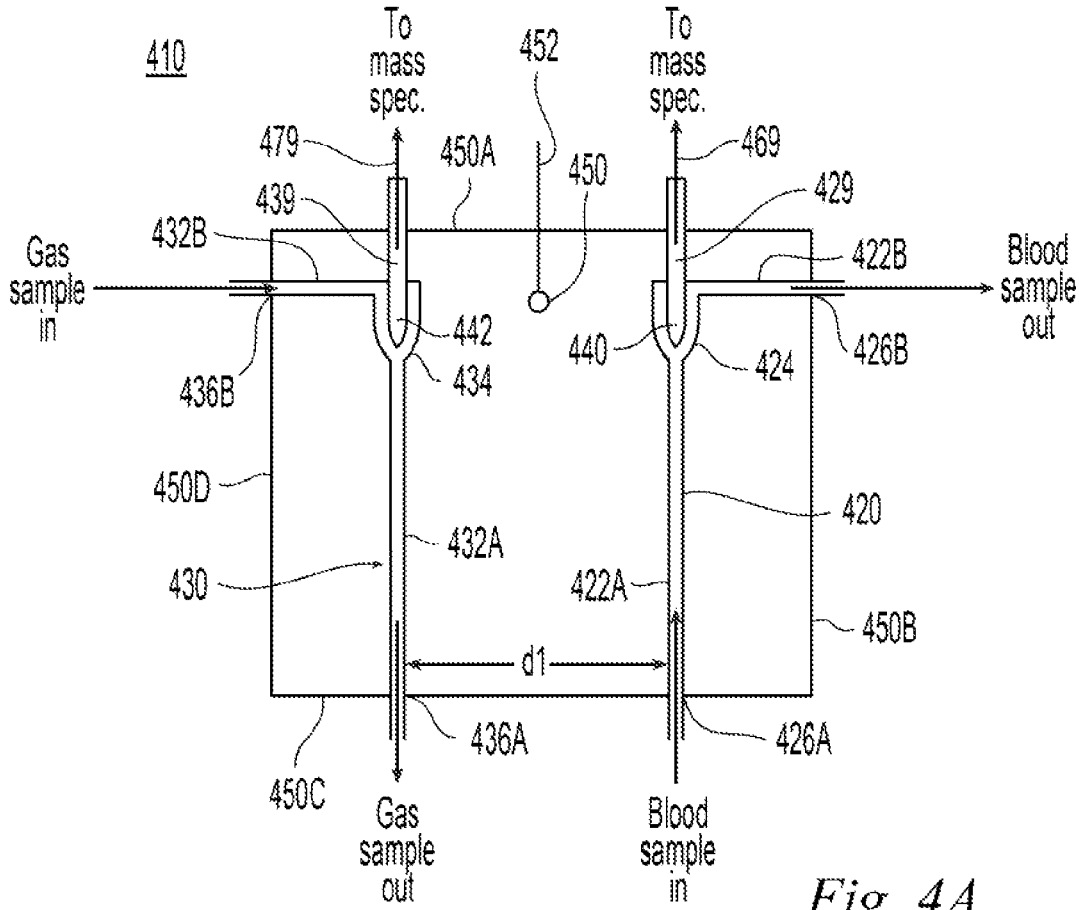
FIGS. 4A and 4B show a third embodiment of a substrate and a side view of a fluidic chip assembly formed with the substrate.
Figure 4B:
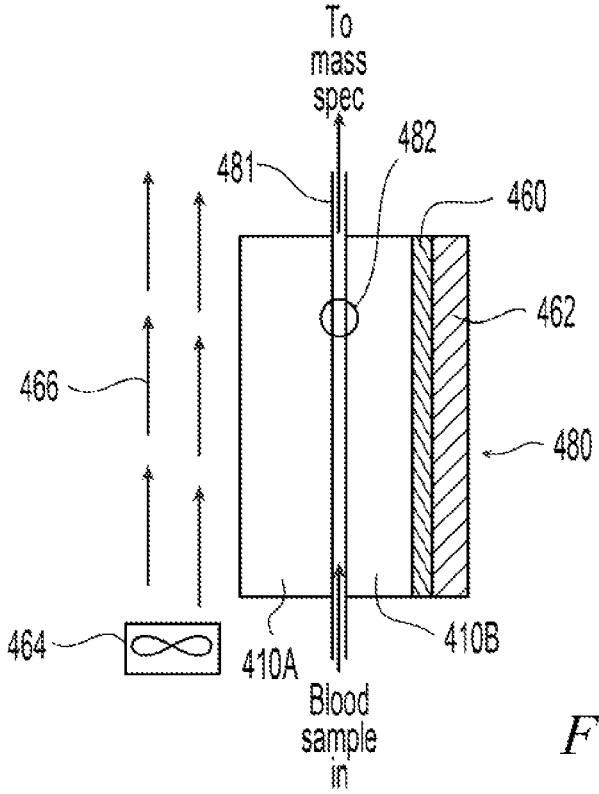

FIGS. 4A & 4B shows yet another embodiment of a substrate block and device in accordance with the present invention. Each substrate block 410 (only one being shown) has four peripheral edges 450A, 450B, 450C, 450D and is provided with two L-shaped grooves 420, 430. Each L-shaped groove comprises a first leg 422A, 432A and a second leg 422B, 432B, the two meeting at an enlarged, cup-shaped elbow region 424, 434. The first leg of each groove has a first end 426A, 436A that communicates with a first edge 450C of the substrate block, the first ends of the two grooves being spaced apart from one another by a first distance d1. One L-shaped groove 420 has a second leg 422B whose second end 426B communicates with a second edge 450B of the substrate block while the other L-shaped groove 430 has a second leg 432B whose second end 436B communicates with a third edge 450D, the second and third edges 450B, 450D facing in opposite directions. A pair of spaced apart straight grooves 429, 439 connect each enlarged elbow region to the fourth edge of the substrate block. These straight grooves 429, 439 preferably are collinear with the first legs of corresponding L-shaped grooves.

In the assembled device, when the two substrate blocks are brought together, the L-shaped grooves form two L-shaped through channels. Meanwhile, the straight grooves form two passages for accommodating MMIMS sensors 440, 442, the sensing ends of the MMIMS sensors being positioned in the cup-shaped elbow regions 424, 434, respectively. This arrangement allows two fluids, brought to the same temperature using the present invention, to flow past the MMIMS sensors 440, 442 at the same time.

In a preferred use of this embodiment, gas samples are introduced into a first flow channel formed by second grooves 430, while a blood sample is introduced into the second flow channel formed by first grooves 420. As seen in FIG. 4A, the gas sample is shown to flow in a direction opposite that of the blood sample (i.e., from the second end 436B towards the first end 436A), although it may instead be configured to flow in the reverse direction.

These two fluid samples are guided by their respective flow channels to flow over MMIMS sensors 440, 442, which have multiple pores filled with polymer membrane separating the fluid samples from ultra-high vacuum. Inert gases in the gas or blood samples permeate through the polymer membrane into the ultra-high vacuum system and from there enter the ion source of a mass spectrometer, as depicted by arrows 469, 479, for analysis of the inert gas partial pressures in the fluid samples. MMIMS sensors such as those disclosed in U.S. Pat. Nos. 5,834,722 and 6,133,567 whose contents are incorporated by reference, among others, may be used for this purpose.

FIG. 4B shows a side view of a device 480 formed from two substrate blocks 410A, 410B of the sort seen in FIG. 4A. In this side view, a first tube 481 is seen directing the sample obtained by the MMIMS probe to a mass spectrometer while a second tube 482 coming out of the page directs the exiting blood sample away from the device 480. The substrate blocks in this embodiment preferably are aluminum blocks, ⅜ inches thick, with machined slots in their mating faces to accommodate the gas and blood sample tubing and the MMIMS probes. The heat source 460 in this embodiment preferably is a commercially available etched foil heater pad designed to provide uniform heat per unit area. An insulative material 462 is positioned on an outer surface of the heater 460. The heat sink in this embodiment comprises a fan 464 that provides forced air convection, as depicted by arrows 466, on the heat sink surface of the second outer surface of the second substrate block, with the heat transfer coefficient controlled by control of the fan speed. It should be noted, however, that other types of heat sinks, such as thermoelectric devices, flowing liquids, and the like, may be used instead.

From the foregoing, it can be seen that the present invention may provide consistent temperature regulation of multiple samples with different heat capacities.

Consistent temperature regulation of multiple samples with different heat capacities may be achieved by controlling both the heat input and the heat output of the fluidic chip, and adjusting the designed steady-state heat flux through the fluidic chip to a value that is much larger than the heat required to heat the small fluid samples.

With a material of high thermal conductivity, such as aluminum, a relatively large heat flux can pass through the fluidic chip from the heat source to the heat sink with minimal temperature gradient in the fluidic chip, thus keeping the fluidic chip nearly isothermal. Providing a steady-state heat flux that is much larger than the heat required to warm the fluid samples, results in the desirable property that the temperature at any point within the fluidic chip is primarily determined by the fluidic chip heat flux and its accompanying small temperature gradient within the fluidic chip. Thus, the heat transferred to or from the fluid samples has a minimal effect on local temperature.

Because each sample has negligible effect on the local fluidic chip temperature, differences in thermal characteristics between samples, such as heat capacity, sample flow rates, sample volumes, and sample initial temperatures, are also negligible in terms of their effect on sample temperature.

It can also be seen from the foregoing, that the present invention may also provide the ability to rapidly change the temperature of the samples and sensors.

The ability to change the temperature of samples and sensors rapidly is achieved by the orthogonal geometry of the design. All of the fluid samples are arranged in the narrow first volume between the two imaginary planes. The well or channel depth, and hence the thickness of the first volume, is so small, that we can approximate this, for thermal purposes, as a single y-z samples plane. The samples are present between two conductive substrate blocks, or slabs. Furthermore, both the heat source and the heat sink are arranged to approximate uniform sources of heating and cooling in planes parallel to the y-z samples plane. Therefore the heat flux through the substrate blocks is orthogonal to the y-z samples plane, with heat proceeding from the heat source to the heat sink in the "x" direction. Because of this planar geometry, the fluid samples in the y-z plane will be isothermal, and control of this sample temperature in the y-z plane reduces to controlling the temperature at a single point in the temperature gradient in the x direction.

Rapid increases in the sample temperature can then be facilitated by temporarily overheating the substrate block between the heat source and the samples. Immediately following this pulse of heat, temperature overshoot in the y-z plane can be avoided by temporarily increasing the heat loss from the substrate block between the samples and the heat sink. Although rapid changes in the temperature of the y-z plane could be implemented with conventional PID control algorithms, the advantages of the orthogonal heat flux geometry in creating rapid temperature changes without overshoot become most pronounced when smart control algorithms are used to control both the heat source and heat sink.

This allows for precise and uniform temperature regulation over the period of the measurement, and high accuracy temperature measurement and control, even with a single temperature sensor.

It will be apparent to those skilled in the art that the system and method of the present invention may be employed in a variety of settings.

First, the present invention is believed to meet the four requirements for temperature control in the MIGET by MMIMS analysis. These four requirements include: (1) provide for the temperature regulation of multiple fluid samples (e.g., one gas sample and two blood samples) when the individual samples have widely differing heat capacities and flow rates; (2) provide temperature regulation that is highly accurate, preferably within 0.1° C., and uniform over several minutes; (3) provide steady-state temperature regulation for the blood and gas samples that is highly accurate, preferably within 0.1° C., and uniform amongst the gas and blood samples and their sensors; and (4) provide for rapid and predictable changes in the controlled temperature between sample sets.

As to the first requirement, in the MIGET by MMIMS analysis, the blood and gas samples both start at room temperature and both must be heated to be analyzed at precisely the same body temperature, but the heat required to warm the blood sample is considerably greater than the heat required to warm the gas sample, because the blood sample has a much larger heat capacity. The dominant determinant of the temperature in the y-z plane (or, more precisely, the narrow volumetric slice between the two imaginary planes), however, is the heat flux from the heater to the heat sink. Because this heat flux is large compared to the heat required to warm the blood samples, both the blood and gas samples are controlled to nearly identical temperatures, regardless of the each sample's heat capacity, flow rate, or starting/stopping flow patterns during sample injection and analysis.

As to the second requirement, in the current invention, heat loss from the conductive second substrate block is not left to the vagaries of natural convection but rather the heat loss is tightly controlled by use of forced convective heat transfer. As a result, oscillations around the temperature set point over time are reduced compared to conventional heater blocks.

As to the third requirement, even for steady-state temperature regulation, many heater designs will not provide high-precision uniformity across samples, simply because virtually all heaters (or heat sinks) have some non-uniformities in their heat production per unit area (or heat absorption per unit area). For example, resistive heaters made of numerous fine wires uniformly distributed to approximate uniform heat flux will still have more heat produced in the vicinity of the wire than in the open spots between wires. Placing a conductive substrate block on both sides of the samples smoothes out these potential non-uniformities in the y and z directions.

As to the fourth requirement, in the MIGET by MMIMS analysis, sequential sets of samples from different subjects require analysis at different body temperatures. The ideal profile for temperature versus time after finishing with one set of samples would be an instantaneous step change from the last temperature to the new body temperature. In practice, no temperature controller can achieve this ideal. In conventional conductive heater blocks with PID control, the substantial mass of the thermal block slows the temperature response to a step change in heater output. A more rapid rise in block temperate can be achieved by temporarily overshooting the heat output from the heater, but at the expense of temperature overshoot in the block. In the current invention, the controlled temperature is not the entire substrate temperature but rather a single temperature in the temperature gradient in the x direction. Temperature overshoot and undershoot in transient temperatures in other parts of the substrates can be intentionally manipulated to achieve a better approximation of a step change in the y-z plane. These benefits are most pronounced when smart control algorithms are used to control both the heat source and heat sink.

A second application may be in Arterial Blood Gas (ABG) analysis. ABG is traditionally performed at the single temperature of 37.0° C., and then the measured values of $PO_2$, $PCO_2$, and pH are corrected to the patient's body temperature. These temperature corrections are based on the average behavior of blood gas values in a population of patients. These average values, however, are not necessarily applicable to a given individual. It would be desirable in ABG analysis to shift the temperature of the conductive block containing the electrodes to the exact patient's temperature for each patient. Development of temperature controllers capable of doing this has been hampered by the natural conflict between the tightly regulated temperature control required in ABG analysis, versus the ability to shift the control temperature rapidly between samples. It may be possible to meet both of these requirements using the present invention.

Third, chemical reactions sometimes need specific control at certain temperatures for specific reactions, but rapid changes of the reactor temperature between these reactions. An example is the polymerase chain reaction (PCR), which requires repeated cycling between three different temperatures for denaturing the DNA (usually 93° C.), annealing the primers (usually around 55° C.), and extending the base pairs (usually 72° C.). The time required for denaturing and annealing, however, is minimal, and the overall time of cycling is dominated by rapidity of temperature changes of the samples between these set temperatures. The current invention may be able to accommodate discrete samples of different sizes and regulate them uniformly, cycle them rapidly, and reach the target set temperatures precisely. The current invention may also accommodate microfluidic approaches to PCR where multiple sample flow channels could be run in parallel.

Finally, microfluidics (sometimes called lab on a chip) approaches in general attempt to miniaturize and integrate sample purification and preparation, separation (including for example temperature profiling of a GC column), and analysis operations on a single chip. In some cases each of these steps can have different optimal temperatures. The current invention could have applications here as well with control at the precise temperature for each part of the analysis and rapid switching in between. The geometry of the current invention, with fluid channels in a complex pattern but confined to 2-D plane, is particularly suitable for the planar microfabrication techniques that are used in microfluidics.

Although the present invention has been described to a certain degree of particularity, it should be understood that various alterations and modifications could be made without departing from the scope of the invention as hereinafter claimed. It should also be noted here that while the present application uses the term 'fluidic chip' and 'fluidic sample device' these terms are to be interpreted to encompass what are commonly referred in the industry to as 'microfluidic devices'.

What is claimed is:

1. A temperature controlled fluidic sample system comprising:

a fluidic sample device comprising:

a first substrate block having a first inner surface and a first outer surface;

a second substrate block having a second inner surface and a second outer surface;

a first groove formed in the first inner surface, the first groove having first and second ends opening to a peripheral edge of the first substrate block;

the first and second inner surfaces of the first and second substrate blocks facing each other so as to form a first through channel between the first and second substrate, wherein:

the first through channel has first and second ends opening to a peripheral edge of the fluidic sample device;

the first through channel incorporates said first groove;

the first through channel is located between two imaginary planes that are spaced apart by a height (h) of the first through channel, the two imaginary planes being parallel to one another and defining between them a first volume in which the first through channel resides; and at least one temperature sensor configured to measure a temperature within the first volume;

a heater thermally coupled to said first outer surface;

a heat sink thermally coupled to said second outer surface; and a temperature controller configured to receive temperature information from said temperature sensor and cause the heater to provide heat and the heat sink to provide cooling, such that:

a temperature gradient is formed between the first outer surface and the second outer surface; and a desired temperature is maintained within said first volume.

2. The temperature controlled fluidic sample system according to claim 1, further comprising:

a second channel formed in the fluidic sample device.

3. The temperature controlled fluidic sample system according to claim 2, wherein the first channel is occupied by a first fluid, and the second channel is occupied by a second fluid, the first and second fluids having different heat capacities.

4. The temperature controlled fluidic sample system according to claim 3, wherein the first fluid is a liquid and the second fluid is a gas.

5. The temperature controlled fluidic sample system according to claim 2, wherein:

the fluidic sample device has a peripheral edge provided with at least three edge surfaces;

the first end of the first channel is formed in a first edge surface;

the second end of the first channel is formed in a second edge surface;

the first end of the second channel is formed in said first edge surface; and the second end of the second channel is formed in a third edge surface.

6. The temperature controlled fluidic sample system according to claim 5, wherein:

the peripheral edge comprises two pairs of parallel edge surfaces; and the second and third edge surfaces are parallel to one another and face in opposite directions.

7. The temperature controlled fluidic sample system according to claim 2, further comprising:

a first probe in fluid communication with the first channel at a point between the first and second ends of said first channel; and a second probe in communication with the second channel at a point between the first and second ends of said second channel.

8. The temperature controlled fluidic sample system according to claim 7, wherein:

the fluidic sample device has a peripheral edge provided with at least four edge surfaces;

the first end of the first channel is formed in a first edge surface;

the first end of the second channel is formed in said first edge surface;

the second end of the first channel is formed in a second edge surface;

the second end of the second channel is formed in a third edge surface;

the second and third edge surfaces are parallel to one another and face in opposite directions;

the first and second probes both enter the fluidic sample device via a fourth edge surface; and the first and fourth edge surfaces are parallel to one another and face in opposite directions.

9. The temperature controlled fluidic sample system according to claim 8, wherein:

the first and second probes are connected to a mass spectrometer.

10. The temperature controlled fluidic sample system according to claim 9, wherein:

a blood sample occupies the first channel; and a gas sample occupies the second channel.

11. The temperature controlled fluidic sample system according to claim 2, further comprising tubing material occupying the first and second channels.

12. The temperature controlled fluidic sample system according to claim 1, wherein the first and second imaginary planes are parallel to the first and second outer surfaces.

13. The temperature controlled fluidic sample system according to claim 12, wherein the heater provides uniform heat over a surface of said first outer surface, such that a uniform heat flux passes through the fluidic sample device in a direction orthogonal to the first and second imaginary planes.

14. The temperature controlled fluidic sample system according to claim 1, wherein the heater is interposed between a first insulating material and said first outer surface.

15. The temperature controlled fluidic sample system according to claim 1, further comprising:

a second groove formed in the second inner surface, and wherein:

the first and second grooves are L-shaped and combine to jointly form the first channel, in the fluidic sample device.

16. The temperature controlled fluidic sample system according to claim 1, wherein the heat sink is a thermoelectric device.

17. The temperature controlled fluidic sample system according to claim 1, wherein the heat sink is room temperature air.

18. The temperature controlled fluidic sample system according to claim 17, further comprising a fan to pass said air past the second outer surface.

19. The temperature controlled fluidic sample system according to claim 1, wherein the temperature sensor is a thermistor.

20. The temperature controlled fluidic sample system according to claim 1, wherein the temperature controller employs proportional-integral-derivative control.

21. A temperature controlled fluidic sample system comprising:

a fluidic sample device having first and second outer surfaces and at least one internal compartment configured to hold a fluid sample, said compartment being located between two imaginary planes that are spaced apart by a height (h) of said compartment, the two imaginary planes being parallel to one another and also parallel to the first and second outer surfaces, the two imaginary planes defining between them a first volume in which the compartment resides;

at least one temperature sensor configured to measure a temperature within the first volume;

a heater thermally coupled to said first outer surface;

a heat sink thermally coupled to said second outer surface such that the first outer surface and the second outer surface overlap one another in a direction perpendicular to at least one of the outer surfaces; and a temperature controller configured to receive temperature information from said temperature sensor and cause the heater to provide heat and the heat sink to provide cooling, such that:

a temperature gradient is formed between the first outer surface and the second outer surface; and a desired temperature is maintained within said first volume.

22. The temperature controlled fluidic sample system according to claim 21, wherein the temperature controller is configured to implement proportional-integral-derivative control.

23. A method of controlling temperature of at least two fluidic samples having different heat capacities, the method comprising:

passing first and second fluidic samples along first and second paths formed in a common device, the first fluidic sample having a first heat capacity and the second fluidic sample having a second heat capacity, said first and second paths being substantially along a common plane within said device;

forming a temperature gradient in a direction orthogonal to said plane such that a uniform heat flux passes through said plane, the temperature gradient being formed between a heater thermally coupled to said device and providing heat on one side of the plane, and a heat sink thermally coupled to said device and providing cooling on an opposite side of the plane;

measuring a temperature of the device at a point in said plane, said point being between the first and second paths; and adjusting at least one of the heater and the heat sink, based on the measured temperature of the device.

24. The method of controlling temperature of at least two fluidic samples according to claim 23, wherein the first and second fluidic samples have different flow rates along respective first and second paths.

25. The method of controlling temperature of at least two fluidic samples according to claim 23, comprising employing proportional-integral-derivative control to adjust the heater.

26. A method of controlling temperature of at least two fluidic samples, the method comprising:

passing first and second fluidic samples along first and second paths formed in a common device, the first fluidic sample having a first flow rate through the device and the second fluidic sample having a second flow rate through the device, said first and second paths being substantially along a common plane within said device;

forming a temperature gradient in a direction orthogonal to said plane such that a uniform heat flux passes through said plane, the temperature gradient being formed between a heater thermally coupled to said device and providing heat on one side of the plane, and a heat sink thermally coupled to said device and providing cooling on an opposite side of the plane;

measuring a temperature of the device at a point in said plane, said point being between the first and second paths; and adjusting at least one of the heater and the heat sink, based on the measured temperature of the device.

27. The method of controlling temperature of at least two fluidic samples according to claim 26, comprising employing proportional-integral-derivative control to adjust the heater.

28. The temperature controlled fluidic sample system according to claim 1, wherein the desired temperature at which said volume is maintained is within 0.1° C. of a predetermined value.

29. The temperature controlled fluidic sample system according to claim 21, wherein the desired temperature at which said volume is maintained is within 0.1° C. of a predetermined value.

30. The method of controlling temperature of at least two fluidic samples according to claim 23, wherein adjusting at least one of the heater and the heat sink maintains a temperature at said point within 0.1° C. of a predetermined value.

31. The method of controlling temperature of at least two fluidic samples according to claim 26, wherein adjusting at least one of the heater and the heat sink maintains a temperature at said point within 0.1° C. of a predetermined value.

* * * * *